US010004658B2

(12) United States Patent
Marty et al.

(10) Patent No.: US 10,004,658 B2
(45) Date of Patent: Jun. 26, 2018

(54) DEVICE AND METHOD FOR MASSAGE AND APPLICATION OF A COSMETIC PRODUCT

(71) Applicant: PIERRE FABRE DERMO-COSMETIQUE, Boulogne (FR)

(72) Inventors: Olivier Jean Marty, Castres (FR); Marie Chenal, Castres (FR); Bénédicte Roucayrol, Labastides Saint Georges (FR)

(73) Assignee: PIERRE FABRE DERMO-COSMETIQUE, Boulogne (FR)

( * ) Notice: Subject to any disclaimer, the term of this patent is extended or adjusted under 35 U.S.C. 154(b) by 0 days. days.

(21) Appl. No.: 15/149,051

(22) Filed: May 6, 2016

(65) Prior Publication Data

US 2017/0319429 A1 Nov. 9, 2017

(51) Int. Cl.

| | |
|---|---|
| ***A61H 15/02*** | (2006.01) |
| ***A61H 15/00*** | (2006.01) |
| ***A45D 34/04*** | (2006.01) |
| *A61H 7/00* | (2006.01) |

(52) U.S. Cl.

CPC ..... *A61H 15/02* (2013.01); *A45D 34/041* (2013.01); *A61H 15/0092* (2013.01); *A61H 7/002* (2013.01); *A61H 7/003* (2013.01); *A61H 7/007* (2013.01); *A61H 2015/0007* (2013.01); *A61H 2015/0014* (2013.01); *A61H 2015/0021* (2013.01); *A61H 2015/0057* (2013.01); *A61H 2201/105* (2013.01);

(Continued)

(58) Field of Classification Search

CPC ..... A61H 7/00; A61H 7/002; A61H 7/003; A61H 7/007; A61H 2007/009; A61H 15/00; A61H 15/0092; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 2201/105; A61H 15/02; A45D 26/0004; A45D 26/0033; A45D 26/0038; A45D 26/0061; A45D 26/0028; A45D 26/0023; A45D 24/22; A45D 34/041

USPC ..... 601/17, 19, 94, 112, 118, 122, 125, 119, 601/134, 135, 133

See application file for complete search history.

(56) References Cited

U.S. PATENT DOCUMENTS 4,775,256 A * 10/1988 Roth ..... A47K 7/03 401/145
6,436,062 B1 * 8/2002 Iwamoto ..... A61H 15/00 601/122

(Continued)

FOREIGN PATENT DOCUMENTS

EP 1 472 953 A1 11/2004

*Primary Examiner* — Colin W Stuart

(74) *Attorney, Agent, or Firm* — Im IP Law; C. Andrew Im

(57) ABSTRACT

A massager device includes a structure having a contact face and a handling face. A pair of notched rollers is on the contact face of the structure. The notched rollers freely rotates around intersecting axes. The notched rollers are attached to the structure by elastic suspensions. A gripping shape is on the handling face of the structure, opposite to the contact face. The gripping shape forms a cap wrapping the surface of the structure.

11 Claims, 5 Drawing Sheets

(52) U.S. Cl.
CPC ..... *A61H 2201/5071* (2013.01); *A61H 2201/5079* (2013.01); *A61H 2201/5082* (2013.01)

(56) References Cited

U.S. PATENT DOCUMENTS

| | | | | |
|---|---|---|---|---|
| 7,537,574 | B2 * | 5/2009 | Gueret | A45D 34/041 601/17 |
| 2003/0120185 | A1 * | 6/2003 | Dirks | A61H 15/0085 601/15 |
| 2005/0203445 | A1 * | 9/2005 | Tsai | A61H 15/02 601/15 |
| 2005/0251071 | A1 * | 11/2005 | Zhadanov | A61H 7/003 601/136 |
| 2010/0191160 | A1 * | 7/2010 | Avramovich | A61H 7/004 601/94 |
| 2012/0121313 | A1 * | 5/2012 | Thiebaut | A61H 7/003 401/195 |
| 2012/0273385 | A1 * | 11/2012 | Lim | A45C 11/008 206/581 |
| 2014/0128780 | A1 * | 5/2014 | Kennedy | A61N 5/0616 601/18 |
| 2014/0148744 | A1 * | 5/2014 | Caldirola | A61H 15/0092 601/119 |
| 2015/0119771 | A1 * | 4/2015 | Roberts | A61H 39/04 601/135 |
| 2015/0165238 | A1 * | 6/2015 | Slayton | A61B 18/18 601/2 |
| 2015/0265871 | A1 * | 9/2015 | Patel | A63B 21/0004 482/8 |
| 2015/0305969 | A1 * | 10/2015 | Giraud | A61H 7/005 601/18 |
| 2016/0090199 | A1 * | 3/2016 | Lasnier | B65D 47/248 141/383 |

* cited by examiner

DEVICE AND METHOD FOR MASSAGE AND APPLICATION OF A COSMETIC PRODUCT

FIELD OF INVENTION

The invention relates to a device and a method for the massage and the application of a cosmetic product. The invention belongs to the field of the cosmetic care devices, as well as wellbeing and beauty, acting superficially on the skin, without intrusion, to get an effect known as draining with an aim of strengthening and of softening the skin and of improving its aspect, in particular with respect to dimplings and cellulite.

The invention aims at allowing a user, without particular knowhow, to implement a technique of slimming massage also known as "palpate-roll" or "pinch-to roll", more particularly, but not exclusively, on the low parts of the body, like the calves, the thighs, the buttocks, the hips and the abdomen, but also the arms.

BACKGROUND OF THE INVENTION

The technique of "palpate-roll" is generally performed by a professional and requires, in order to be efficient, regular sessions, and a cosmetic care professional, mastering the gesture consisting in pinching the skin and making propagate the fold thus formed with the appropriate speed and pressure, and in the adapted direction. In order to further improve the effectiveness of the massage, the skin is advantageously prepared by the application of creams or adapted oils, before the massage. Going to multiple sessions with such a professional in order to carry out the massage, is a constraint that encourages the people to practise themselves this type of massage, either for economic reasons, or for a better match to their pace of life. However, the control of the gesture is delicate, especially taking into account the fact that the person is then oriented with regard to the part of her body in the opposite direction of that of the professional: considering the position of the thumbs, applying the pressure and the propagating the fold of skin manually, are more difficult in the pulling direction than in the pushing direction. Certain parts of the body like the buttocks or the back of the thighs, cannot be reached under good conditions in a situation of self-massage.

Document EP 1.472.953 describes an device allowing, by means of rollers, to subject the skin to a treatment, close in its effects, to the "palpate-roll" gesture, by rolling the aforementioned rollers on the part of the body that is to be massed. However, the ergonomics of this device is badly adapted for a massage in the appropriate direction, i.e. bottom up. In addition, if this device allows the application of a cream or of a massage oil, it must be applied before the passing of the rollers. Consequently, the use of such a device is difficult in some circumstances where it would prove to be most useful, in particular under the shower.

OBJECT AND SUMMARY OF THE INVENTION

The invention aims in its embodiments at solving the drawbacks of prior art and relates for this purpose to a massager device comprising:

- a structure comprising a contact face and a handling face;
- on the contact face of the structure, a pair of notched rollers, freely rotating around intersecting axes;
- said notched rollers being attached to the structure by elastic suspensions;

- on the handling face of the structure, opposite to the contact face, a gripping shape forming a cap wrapping the surface of the structure.

Thus, the prehension cap allows a good grip in the hand. As the rollers are placed on the face opposite to the gripping shape, it is easy to apply, at the same time, the required pressure and to carry out the displacement of the device while maintaining this pressure, whatever the part of the body which is massed, including the bottom and rear parts of the body The suspensions of the rollers make it possible to control the exerted pressure, and the intersecting axes of rotation of the aforesaid rollers, ensure the effect of pinching and propagation of the skin fold during the subsequent displacement of the massager device.

The invention is advantageously implemented according to the embodiments described hereafter which are to be considered individually or according to any technically operative combination.

According to an advantageous embodiment, the device of the invention comprises:

- on the contact face, an orifice for dispensing a cosmetic product;
- a cosmetic product tank, placed inside the cap, and in fluid communication with the aforementioned dispensing orifice.

Thus, the device of the invention makes it possible to apply a cosmetic product on the skin at the same time as the massage. The location of the orifice on the contact face makes it possible to protect the applied cosmetic product from being leached, in particular when the massage is carried out under the shower.

According to an embodiment of the massager device of the invention, the dispensing orifice is closed by an obturator which opens when a pressure is applied to the contact face. Thus, the obturator avoids the leak of the cosmetic product by the dispensing orifice when the device is not used.

Advantageously, the opening of the obturator is controlled by the move of the suspensions of the notched rollers. Thus, only the application of the massage pressure makes it possible to dispense the cosmetic product.

Advantageously, the device of the invention comprises:

- a pump for expelling the product from the tank to the dispensing orifice;
- a knob to actuate the pump on the handling face.

Thus the user easily controls the dispense of the cosmetic product when carrying out the massage.

Advantageously, the pump and the knob consist in a flexible membrane closing the tank on the handling face, so that a pressure on the aforementioned membrane changes the volume of the tank. Thus, the pump is entirely mechanical, without moving parts and without the need for an internal energy supply.

Advantageously, the device of the invention comprises:

- on the periphery of the contact face, a skirt made up of a flexible material adapted to glide on the skin.

Thus, the protection of the contact face with regard to water during a use under shower is improved, and the contact with the skin is more pleasant.

According to a specific embodiment, the device of the invention comprises:

- a transducer indicating the pressure applied on the rollers;
- a transducer indicating the moving speed of the massager device and the direction of rotation of the rollers;
- a sensor to measure the temperature of the skin;

According to an embodiment, the device of the invention comprises an aperture with a specific interface for the filling of the tank by a cosmetic product contained in a container, said container comprising a complementary connecting interface adapted to cooperate with said specific interface. Thus, only the cosmetic products adapted to the use of the device of the invention are usable to fill the tank.

According to another embodiment of the device of the invention, the cosmetic product tank is removable and interchangeable. Thus, the user changes easily the nature of the applied product, said product being proposed as capsules having the shape of the aforesaid tank.

Advantageously, the device of the invention comprises:

means for reading an identifying code related to the product contained in the tank.

The various sensors make it possible, by their measurements, to qualify the conditions of massage.

For this purpose, the device of the invention comprises advantageously:

an electronic module comprising:

memory means;

an input port and an output port;

a microprogram for the acquisition and the analysis of information issued by the sensors.

Thus, through its microprogram, the electronic module allows to define the actual massage conditions, according to a parameter or to a combination of parameters measured by means of the sensors.

Advantageously, the device of the invention comprises:

a sensory means of information, controlled by the electronic module, delivering an information derived from the analysis of the signals from the sensors.

According to a specific embodiment, the device of the invention comprises:

radio transceiving means and means to establish a wireless personal network with a connected object.

Thus, the analysis capabilities of massage parameters are enhanced by the capabilities of the connected object.

The invention also relates to a method of massage implementing the device including an electronic module and a sensory means of information, comprising the steps consisting in:

i. recording, in the memory means of the electronic module, a range of admissible values of a parameter measured by the information issued from a sensor:

ii. assessing the aforementioned parameter during the massage;

iii. issuing an information to the user, by the sensory means, if the measured parameter is inside the acceptable range or if the measured parameter is outside of the acceptable range.

Thus, the device of the invention interacts with its user in order to guide him in his gesture.

Advantageously, the method of the invention implements a device according to the invention and a connected object and comprises the steps consisting in:

iv. pairing the connected object with the electronic module;

v. transmitting to the connected object, the values of the parameter that is measured during the massage.

Thus the connected object can keep in its memory the parameters qualifying the massage and opens the possibility of a further analysis of those.

According to an advantageous embodiment, the method of the invention comprises, before step v), a step consisting in:

vi. recording the values of the measured parameter in the memory means of the electronic module.

Thus, the further advantage brought by the enhanced analysis capabilities of the connected object, does not require that said connected object be close to the device of the invention during the massage session.

Advantageously, the connected object is capable to connect to the Internet, and the method of the invention comprises the steps consisting in:

vii. downloading from a server, via Internet, an update of the microprogram of the electronic module;

viii. transferring in the electronic module, via the wireless personal network, the update of the microprogram.

Thus, the processing of the massage data is evolutionary.

BRIEF DESCRIPTION OF THE DRAWINGS

The invention is hereafter exposed according to its preferred embodiments, in no way restrictive, and in reference to the FIGS. 1 to 6 in which.

DETAILED DESCRIPTION OF THE EMBODIMENTS

Figure 1:
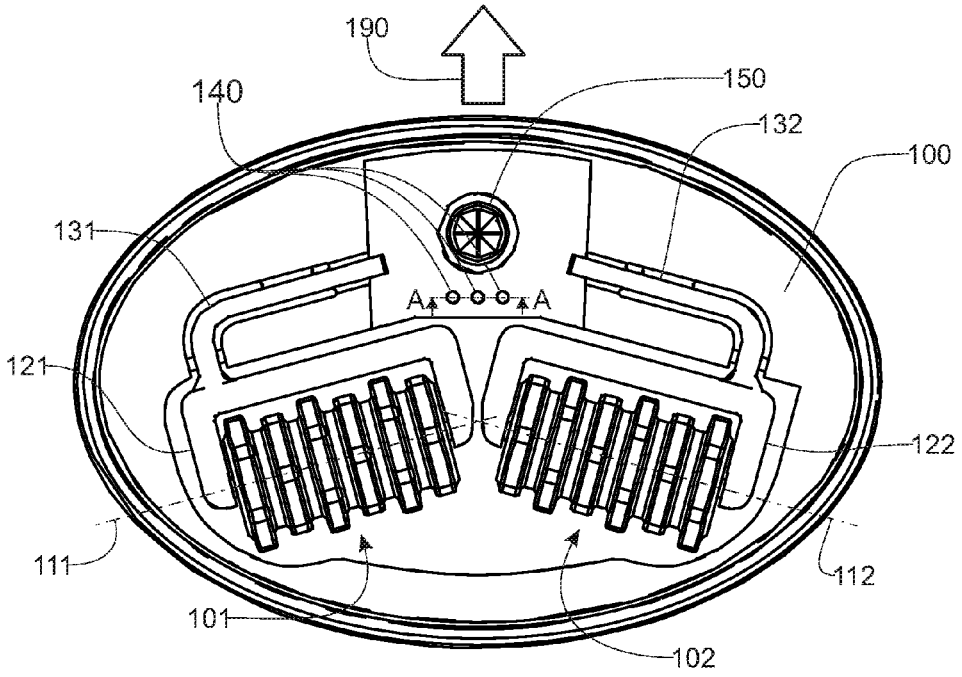
FIG. 1 represents the contact face according to an exemplary embodiment of the massager device of the invention.

FIG. 1, according to an exemplary embodiment, the massager device of the invention is built on a base (100) of elliptic contour. According to this embodiment, the aforementioned base is appreciably planar and made up of a rigid plastic, obtained, for example, by injection molding. It constitutes the most of the contact face of the device of the invention, said contact face is turned towards the skin at the time of performing a massage. According to other exemplary embodiments, the shape the base is not planar and is curved according a simple or a double curvature, or its contour follows a more angular design, for example octagonal, or follows a circular form, without these examples being restrictive.

The device of the invention comprises 2 rollers (101, 102), set up free to rotate around their respective axes (111, 112) extending in secant directions. According to this embodiment each roller is assembled free to rotate in a cage (121, 122) said cage being elastically linked to the base by suspension arms (131, 132). The contact face of the device of the invention comprises one or more orifices (140) for dispensing of a cosmetic product. According to this embodiment, the contact face also includes a filling aperture (150), for the filling of a cosmetic product tank, said tank being in fluid communication with the aforementioned dispensing orifices (140). According to a specific embodiment, the aforementioned filling aperture (150) comprises a specific mechanical interface (not shown) to allow its filling only by means of containers comprising the adapted complementary mechanical interface, and thus limits the nature of the products likely to be introduced into the aforementioned tank. According to a nonrestrictive example, the aforementioned tank comprises a diaphragm or a valve that only a nozzle of adapted conicity or diameter is capable to open.

The cosmetic product dispensing orifices (140) are placed so that, according to the recommended direction (190) of use of the device of the invention, the cosmetic product is delivered on the skin right before the passage of the rollers (101, 102) on the massed zone. The position of the aforesaid orifices (140) is, according to this embodiment, appreciably aligned with the point of intersection of the rotation axes (111, 112) of the rollers. Thus, the cosmetic product is precisely dispensed on the zone subjected to the massage. The aforementioned dispensing orifices (140) being placed on the contact face, the distributed product is protected from the washout during the use of the device under the shower.

According to this embodiment the shape of the rollers (101, 102) comprises a plurality of polygonal discs with rounded angles, juxtaposed according to the axis of rotation (111, 112) of the roller, and angularly shifted around this axis from one to the other. Each angle of the aforesaid polygonal discs constitutes a projecting notch with regard to the inscribed circle in the polygonal profile. The notched shape of the rollers, combined with their secant axes of rotation (111, 112), makes it possible to obtain, during the displacement of the device applied to the skin, an kneading effect, the skin located in front of the rollers, in the recommended direction (190) of progression, being compressed, whereas the skin located behind the rollers is stretched. Thus, the displacement of the device of the invention on the skin, driving the rollers in rotation, reproduces the effect of a "palpate-roll" massage. The rollers are made out of a material having a certain flexibility like an elastomer, for example out of silicone.

According to alternate embodiments, the dispensing of the cosmetic product by the orifices (140), is carried out either by gravity or by pumping means.

Figure 6:
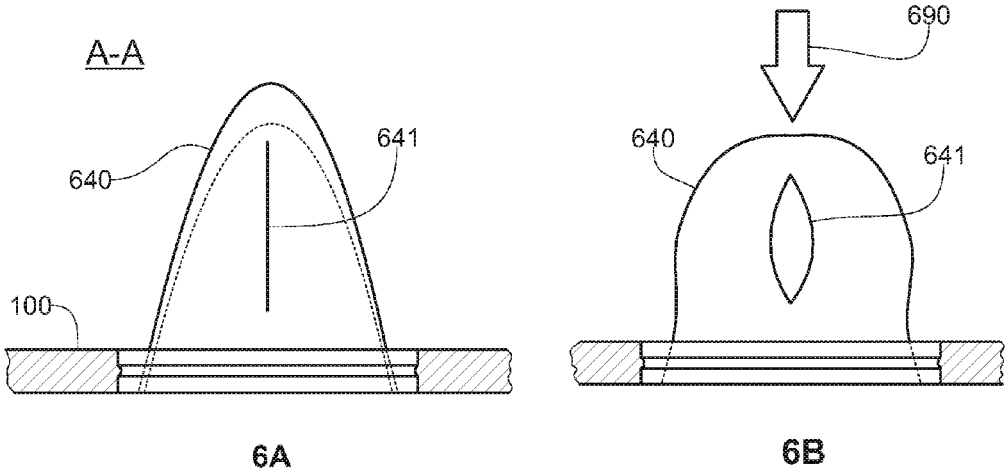
FIG. 6 shows, according to a partial sectional view AA defined in FIG. 1, an exemplary embodiment of an obturator for an orifice dispensing a cosmetic product of the device of the invention, sealed in FIG. 6A, and opened in FIG. 6B.

FIG. 6, in a case as in the other, according to a specific embodiment, the cosmetic product dispensing orifices are equipped with obturators making it possible to prevent the leak of the product by the aforementioned orifices when the massager device of the invention is not applied on the skin. Thus, according to an embodiment, the aforementioned obturators consist of flexible nipples (640), made of an elastomer, crimped in the dispensing orifices. FIG. 6A, each nipple (640) comprises one or more side slits (641), the edges of the said slits being jointed when the nipple (640) is not compressed, i.e. when the device of the invention is not applied on the skin. The viscosity of the cosmetic product is in generally high enough for the product not to flow through a slit (641) with jointing edges. FIG. 6B, in a situation of massage, the pressure (690) exerted on the skin tends to crush the nipple (640) and to draw aside the edges of the slit (641), enabling the cosmetic product to flow through the slit. When the pressure (690) is released, the nipple (640) returns to its initial shape by elasticity, the edges of the slit (641) are again jointed and prevent the flow of the product.

According to another embodiment (not shown) the obturators of the dispensing orifices are valves, whose opening is triggered by the displacement, under the effect of the massage pressure, of the suspension arms of the rollers. This last embodiment of the obturators makes it possible to contain a very fluid cosmetic product.

Figure 2:
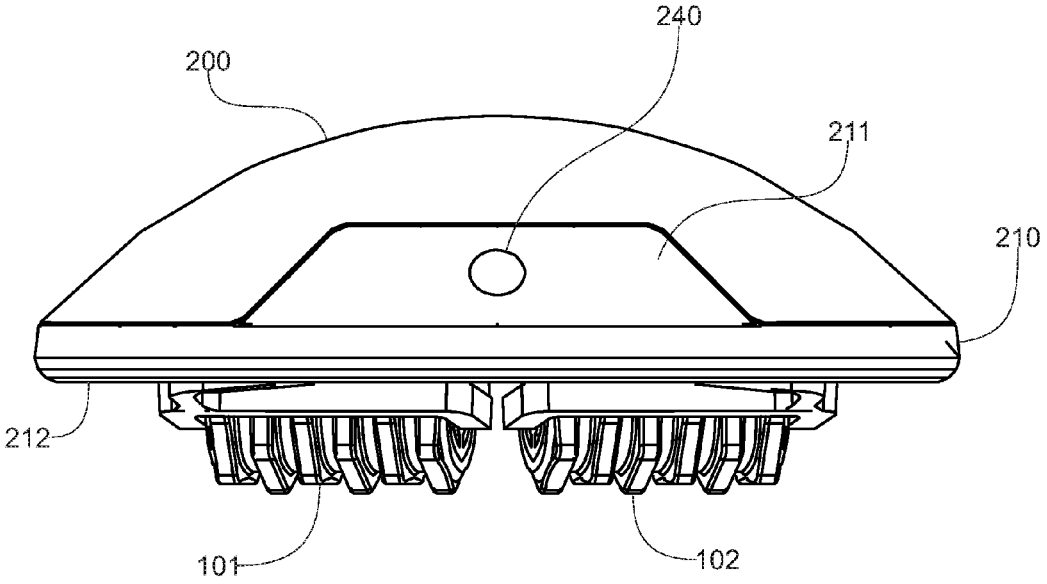
FIG. 2 shows the device of FIG. 1 seen from the top.

FIG. 2, the device of the invention comprises a handling face (200) in the shape of a cap covering the whole contour of the base. According to this embodiment, the cap is of semi-ellipsoidal shape. The dimensions of the cap constituting the handling face (200) are adapted to a catch in full hand of the device of the invention, with, according to this exemplary embodiment, a length, measured along the major axis of the ellipse, ranging between 120 mm and 170 mm, a width, according to the minor axis of the ellipse, ranging between 70 mm and 100 mm, and a height measured from the base to the top of the cap, ranging between 30 mm and 50 mm.

Figure 4:
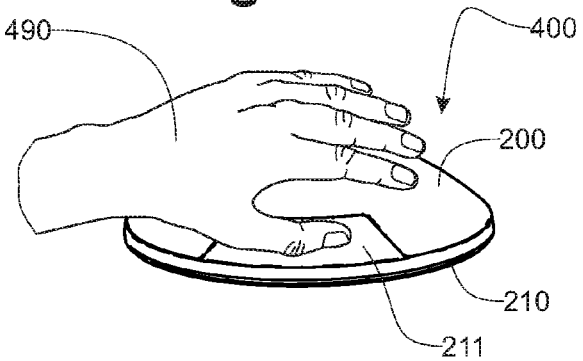
FIG. 4 exemplifies, according to a perspective view, the gripping of the device represented FIGS. 1 to 3, during its application on the skin.

Thus, as shown on FIG. 4, the hand (490) of the user fits the shape of the handling face (200) of the massager device (400), in a configuration comparable with what the hand would take when making a caress on the massed region, leading to a natural gesture with a better control of the exerted pressure.

The handling face (200) is made of a rigid plastic, and advantageously comprises, locally or over its whole surface, one or more zones (211) with a higher flexibility, in order to ease and to secure gripping.

Going back to FIG. 2, according to this embodiment, a skirt (210), made up of a more flexible material, for example of silicone, is assembled to the peripheries of the base and of the cap. The aforementioned skirt is projecting on the periphery of the base and comes into contact with the skin at the time of the massage. According to this embodiment, a part (211) of the skirt is prolonged as flush on a portion of the cap, said portion falling under the thumb of the user during the use of the device of the invention. This part (211) of the skirt thus provides a certain flexibility in the aforementioned cap so as to improve gripping.

According to a specific embodiment, in which the cosmetic product is dispensed by the implementation of pumping means, a knob (240) slightly projects from the cap, for example in an area located under the thumb during the use of the device of the invention. The aforementioned knob (240) actuates the pumping means, making it possible to dispense the cosmetic product contained in the tank.

When free from pressure, the rollers (101, 102) are projecting under the base and the skirt (210). At the time of the massage, said rollers are applied to the skin and the pressure of the hand on the cap making the handling face (200), makes it possible to deform the suspension arms and to lift up the rollers in the base, until the skirt (210) comes into contact with the skin. Thus, the applied pressure by the rollers on the skin, is set precisely by the way of the stiffness of the suspension arms, and their relative position with regard to the contact face and the skirt (210), according to this embodiment. The aforementioned pressure remains thus appreciably constant as long as that the skirt (210) remains in contact with the skin. Each roller being suspended independently, the massager device adapts itself to the shapeliness of the massed region, and the contact of the contact face with the skin, via the skirt according to this embodiment, ensures a perfect positioning of the rollers with regard to the region that is massed, and during the displacement of the device, thus ensuring an optimal effectiveness of the massage effect of the aforesaid rollers. The shape and the constitution of the skirt (210) are designed so that it glides easily on the wet skin or on a skin on which a cosmetic product was applied. Thus, the user of the device of the invention easily keeps an adapted massage pressure while moving the device on the massed region, by keeping the skirt (210) in contact with the skin, without experiencing an unpleasant rubbing of the aforesaid skirt on the skin. According to a particular embodiment, the surface (212) of the skirt coming into contact with the skin, comprises dissymmetrical reliefs (not shown) which make the gliding of the aforesaid skirt on the skin, easier in the appropriate massage direction (190, FIG. 1), and more resistant in another direction of use. Thus, the user instinctively uses the device in the right direction.

Figure 3:
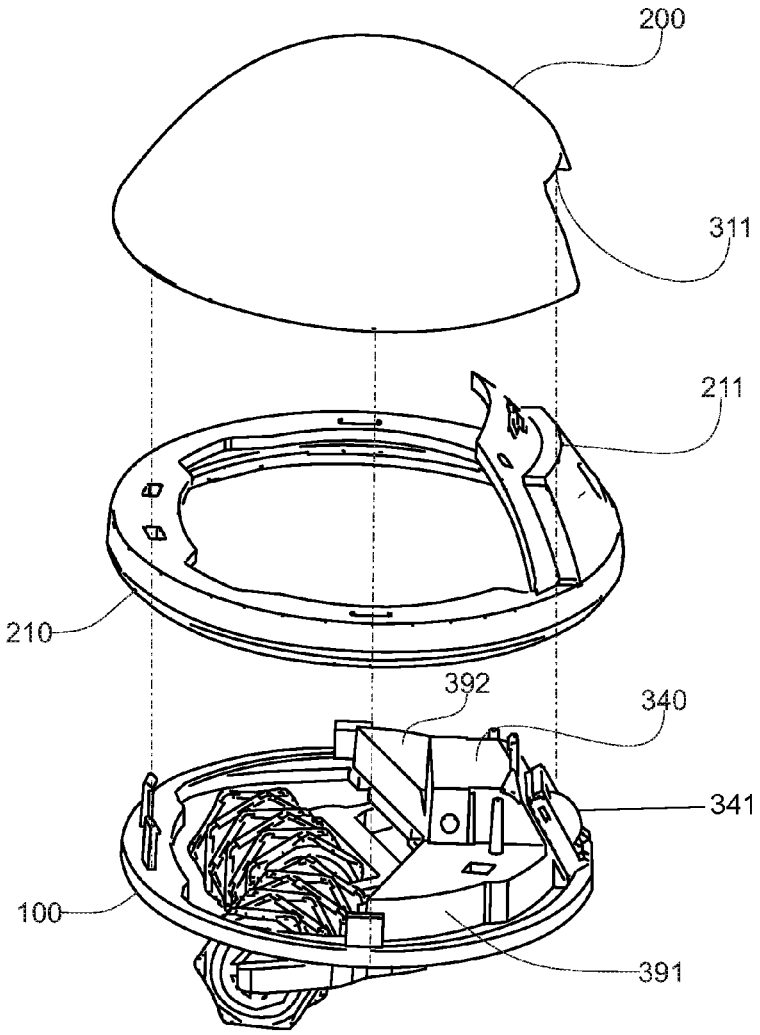
FIG. 3 is a perspective exploded view of the device represented in FIGS. 1 and 2.

FIG. 3, the base (100) and the cap making the handling face (200) are assembled by clipping, the skirt (210) being inserted between the two during the assembly. This embodiment provides an easy assembly of the device of the invention in the framework of a mass production. The rigid base (100) is used as a support for modules conferring on the device of the invention additional functionalities, said modules being hidden and protected by the cap making the handling face (200). Thus, the tank (340) of cosmetic product is fixed to the aforementioned base. According to this embodiment, the aforementioned tank (340) comprises a flexible membrane (341), projecting, after assembly, on the surface of the cap, said membrane constituting the actuation knob for the pumping means. According to this purely mechanical embodiment, a pressure exerted on the aforementioned membrane modifies the interior volume of the tank (340) and produces the pumping effect for expelling the product contained in the tank through the dedicated orifices. This embodiment of the pump also makes it possible to dispense the appropriate quantity of product, the expelled volume being defined by the projecting volume of the membrane (341).

According to another embodiment, the pump is an electric pump, and the knob, on the gripping face drives the actuation of the pump. Advantageously, the start of the electric pump is conditioned with the closing of a contact actuated by the suspension arms of the rollers, so that the cosmetic product can be dispensed only if the aforementioned rollers are applied to the skin.

According to a specific embodiment (not shown), the tank is a removable tank. In this case, the opening (311) of the cap accommodating the prolongation (211) of the skirt, is used to introduce said removable tank. In such an embodiment, the skirt does not include such a prolongation (211) towards the cap, this part being integrated into the removable tank.

Figure 7:
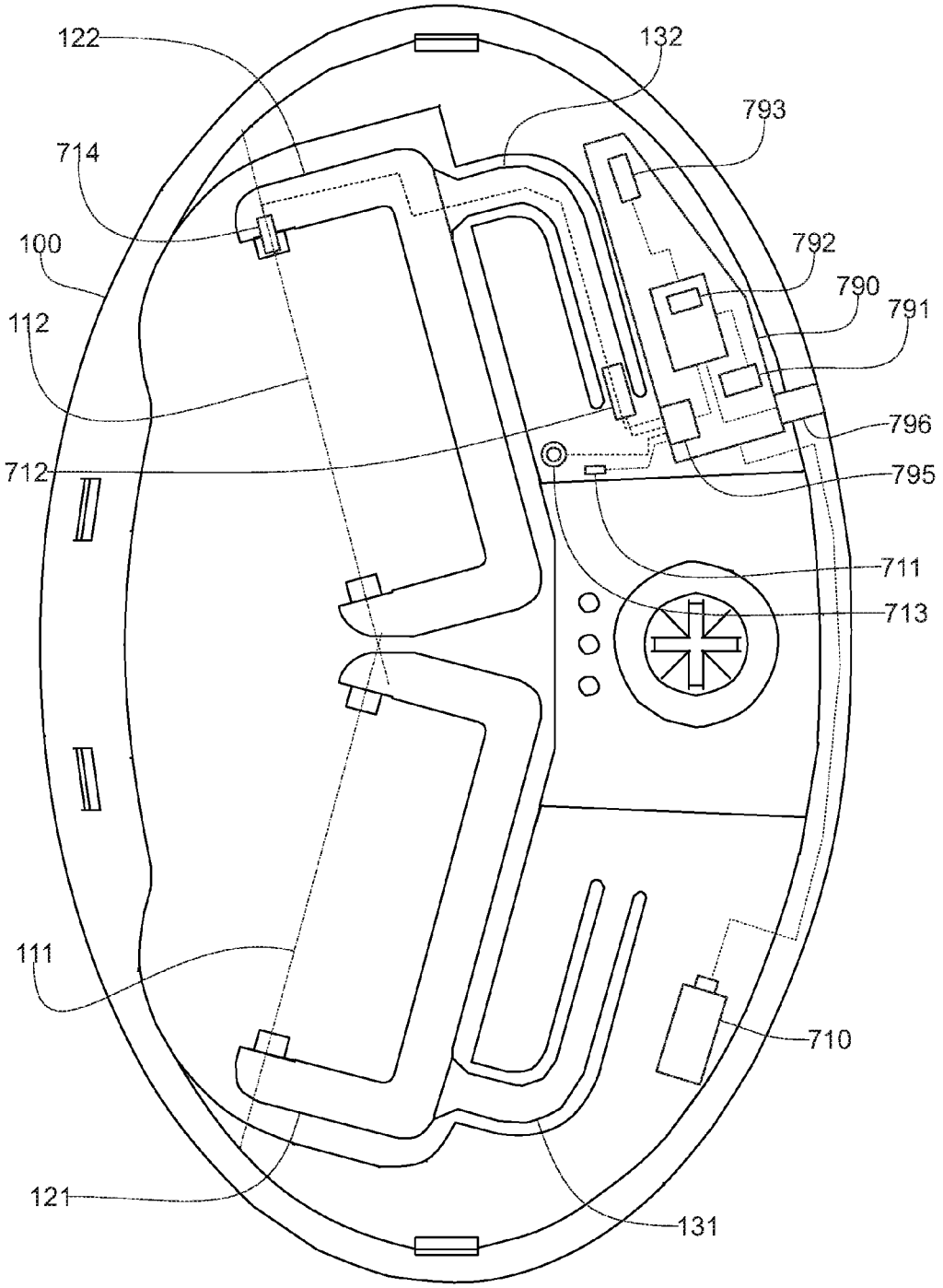
FIG. 7 shows a top view of the base according to an exemplary embodiment of the device of the invention, in an electronic version, a schematic implementation of the electronic components.

According to an embodiment, the base (100) comprises housings (391, 392) receiving electronic means, making it possible to measure and to analyze the massage conditions, as well as batteries (710) for supplying these means in energy. FIG. 7, as non-limiting examples, the aforementioned electronic means comprise individually or in combination:

- a clock for measuring the duration of the massage and its date of performance;
- an accelerometer (711) for assessing the direction and the velocity of the device during the massage;
- a strain gauge (712) or a position sensor of the rollers suspension arms, to determine the pressure exerted during the massage;
- a temperature gauge (713), for example an infrared sensor, for measuring the temperature of the skin; and
- means suitable for reading an identification code of the cosmetic product contained in the tank.

In an embodiment of the device of the invention, where the tank is a removable interchangeable tank, said tank comprises means suitable to cooperate with the means for reading the identification of the product.

In an embodiment of the device of the invention comprising a fixed tank and a filling aperture, said aperture is equipped with means cooperating with complementary means carried by the container used for the filling of the tank, so as to identify the product.

In both of these embodiments, the means of identification, carried by the container of the refill of product, comprise, according to nonrestrictive examples:

- a microchip, or
- a zone comprising electrically conductive and electrically isolating areas, laid out according to a specific pattern, or
- pins or wedges laid out according to a specific pattern.

The reading means carried by the massager device comprise:

- means for reading the microchip of the refill, or
- a set of electrical contacts interacting with the conductive and isolated areas of the refill, or
- knobs actuated by the pins or wedges of the refill.

An electronic module (790) comprising an input port (795) and an output port (796) makes it possible to collect the data issued by all the sensors of the device of the invention and to combine them for their analysis implementing a microprogram (792) recorded in the electronic module (790).

According to this embodiment, the device of the invention, in its version known as electronic, advantageously comprises a sensory means of communication with the user. As examples, the aforementioned sensory means comprise, individually or in combination:

- a visual means, like one or more colored light emitting diodes (LED), or a liquid crystal display;
- sound emitting means, straight or modulated;
- tactile means, like a vibrator.

The sensors (711, 712, 713, 714), the sensory means of communication, the electronic module (790), the battery (710) and all connections between these elements are protected with respect to water jets and an immersion up to 1 meter in depth, and are IP 67 compliant according to IEC 60529 standard. Thus, the device of the invention, in its electronic version, can be used under the shower or in the bath. The electronic components are also selected and protected so that they can withstand, under operation and without any damage, an exposure to a wet temperature of 70° C., during 5 minutes at least.

According to this electronic version of the device of the invention, the electronic module (790) comprises in memory (791) the ranges of values relating to the parameters characterizing the conditions of massage and which are assessed by the processing of the data issued from the various sensors. For example, if to be effective the massage must correspond to displacements from bottom to top of the device on the massed region, with a given minimal pressure and a given maximum speed, the electronic module detects the beginning of the massage by the simultaneous change of the values of the pressure on the rollers and of the displacement of the device. The speed and the direction of displacement are assessed by analyzing the information issued from the accelerometer (711). Alternatively or in a complementary way, information concerning the displacement of the device is obtained by a sensor (714) measuring the rotation of the rollers. As long as the parameters related to the speed, the pressure and the direction of massage are each of them kept inside a value range recorded in the memory means (791) of the electronic module (790), a LED, located for example in a visible area on the handling face of the massager device, lights up in green. If the pressure drops or if the displacement speed becomes too important, or too low, then the LED lights up in red, or, if the sensory means of communication comprise a vibrator, the latter vibrates. Thus, the user is informed instantaneously that he is drifting from the ideal conditions of massage and corrects itself his gesture. For example, the effectiveness of the massage is optimal when repeating several times, for example 3 times, a passage of the device on the same part of the body, according to strokes of a length ranging between 30 cm and 50 cm, from bottom to top in the standing position, and with a speed ranging between 5 $cm \cdot s^{-1}$ and 10 $cm \cdot s^{-1}$, the 3 strokes being made in a 45 seconds maximum time lapse. According to an embodiment, the device of the invention includes an initialization knob (not shown) on the handling face. Before carrying out the massage strokes on a given part of the body, the user pushes the initialization knob thus starting a timing of the 45 seconds open time by the clock, and the lighting of an orange LED, informing the user that the system awaits an action. The orange LED blinks after a 30 seconds time if the 3 strokes were not carried out. The microprogram of the electronic module interprets the data from the sensors in order to detect the performance of each stroke. The detection of a massage stroke is, for example, carried out by the detection of the application of the pressure and the displacement of the device followed by the detection of a stop of the displacement and a release of the pressure. The microprogram counts the strokes and lights a green LED if the three massages were carried out according to the appropriate time lapse and the planned massage conditions.

Advantageously, the electronic module comprises in memory several ranges of values corresponding to the various phases of a care program, implementing various cosmetic products according to its various phases. The nature of the product contained in the tank being detected, the range of value used for the monitoring of the massage conditions is selected accordingly by the microprogram.

According to a simplified embodiment of the electronic version of the device of the invention, the LED lights up in green when the adapted massage pressure is reached and shuts off if this pressure leaves the recommended range.

Advantageously, the LED is also used to inform the user about the state of the battery.

Thus, the implementation of sensors and of an electronic module brings a technical assistance about the adequate use of the massager device and in the performance of a massage under optimal conditions.

Figure 5:
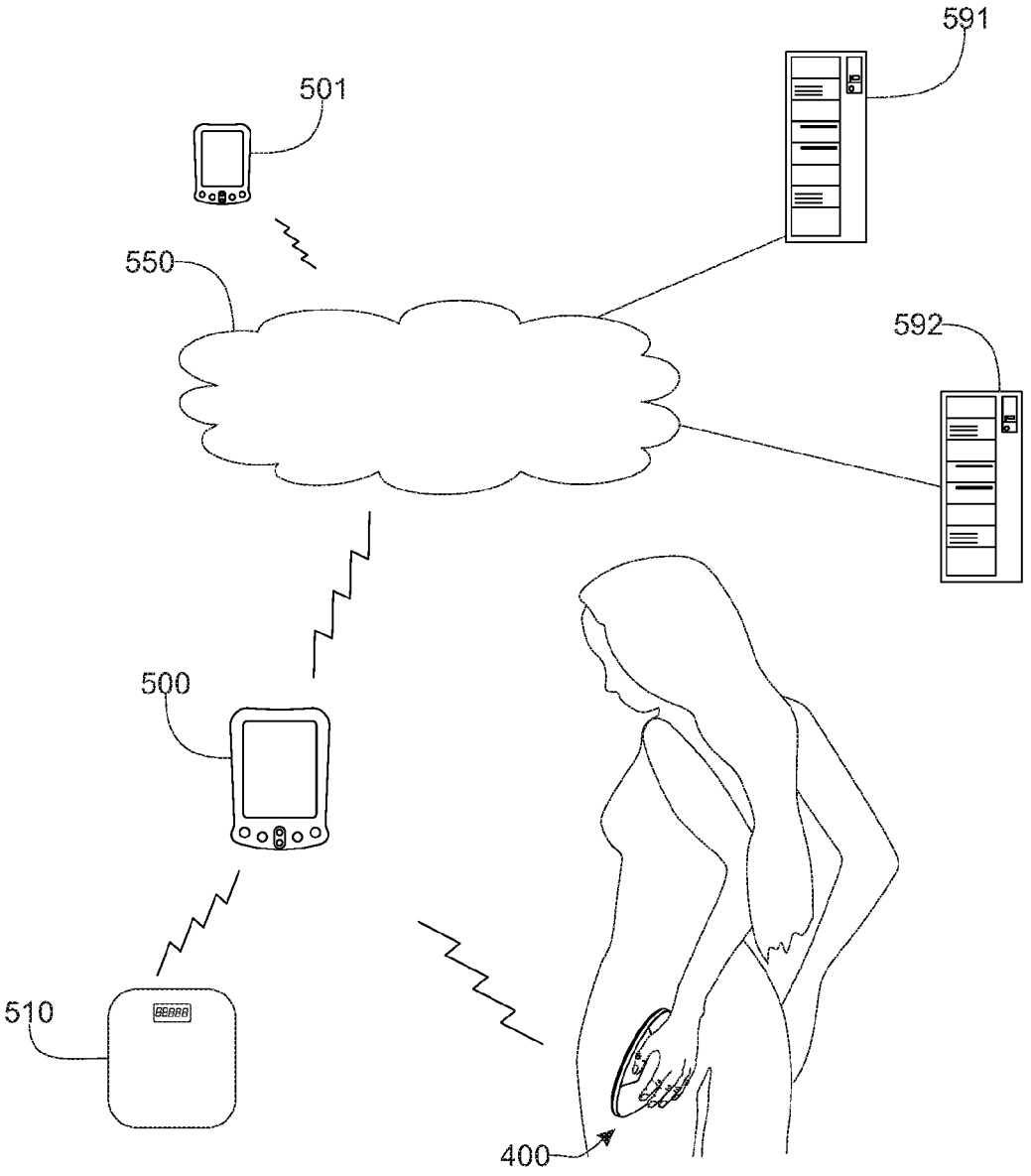
FIG. 5 illustrates the use of the device of the invention in its connected version.

FIG. 5, according to a specific embodiment, the electronic module of the massager device (400) includes means of radio communication (793), suitable to set up a short distance communication with one or more connected objects, for example with a smartphone (500), according to a wireless personal area network, or WPAN. As nonrestrictive examples, the WPAN is established according to a BLUETOOTH® protocol (registered trademark of Bluetooth Sig, Inc., preferentially Bluetooth 4.0 or "low energy", for a lesser power consumption, or according to the ZIGBEE® protocol (registered trademark of Zigbee Alliance Corporation). The range of said short distance radio signals lies between 5 meters and 10 meters and thus allows the data exchange between the massager device (400) and the connected object, whereas the user is under the shower and that the aforementioned connected object stays in a dry place.

As nonrestrictive examples, the connected object is a smartphone, a tablet PC, a laptop computer, the computer of a house automation system, a connected watch or a connected wristband, or a simplified connected device, specifically dedicated to the device of the invention. The connected object comprises memory means, a processor, a display and an input device, like a touch screen or a keyboard.

The connected object, for example a smartphone (500), exchanges data with the electronic module once paired with it, thus creating a WPAN. According to an embodiment, the smartphone (500) is set as master on the network thus created, the electronic module of the massager device (400) being slave.

According to an advantageous embodiment, the aforementioned connected object is connected to Internet (550) by a separate connection. According to the nature of the connected object, this connection with Internet is a wireless connection, for example via a WI-FI® (a registered trademark of Wi-Fi Alliance Corporation) or via a cell phone network, or a wire connection.

According to this embodiment of the device of the invention, known as the connected version, the technical functions for the monitoring of the massage conditions are shared between the microprogram of the electronic module and a software application, setup in the smartphone (500), or in a wider sense, in the connected object.

According to a first aspect, the connected version of the device of the invention enhances the possibilities of interpretation of the data compared to the electronic version, by offering extended calculation capabilities and more memory, and by offering the opportunity of a post treatment of the data, after the performance of the massage, notably in order to take these data into account in a cosmetic care program, the data in the course of the massage remaining treated by the microprogram of the electronic module. For this purpose, the parameters characterizing the massage conditions are stored and timestamped in the memory of the electronic module of the massager device (400), and uploaded to the smartphone (500) when both are paired. Thus, the monitoring of the cosmetic care program is performed even if the smartphone (500) was shut down or was out of range at the time the massage performance.

According to a second aspect, the connected version of the device of the invention, opens the possibility to update of the microprogram of the electronic module. For this purpose, according to an update proceeding, the smartphone (500) connects to an application server (591) via Internet (550), downloads an update of the microprogram, and when paired with the electronic module, transfers the updated microprogram in the memory of the electronic module. According to another embodiment, the information downloaded from the smartphone (500) towards the electronic module of the massager device (400) is limited to the admissible ranges of values of the massage parameter, corresponding to the conditions adapted to the phase of the cosmetic care program in progress.

According to a third aspect, the device of the invention, in its connected version, makes it possible to build a cosmetic care program adapted to the result aimed by the user. For this purpose, the smartphone (500) comprises a software expert system, capable of building the personalized cosmetic care program, according to the information indicated by the user in the aforementioned application, such as his age, his weight, his size, his body measurements and the body regions where he aims an improvement of the skin aspect. Starting from these data, the expert system proposes a massage program, in terms of the number of sessions and the conditions of each session: the massed region, the number of strokes . . . but also defines the corresponding massage parameters and the nature of the cosmetic products to apply at each session. The data exchange between the massager device (400) and the smartphone (500) makes it possible to ensure the monitoring of the cosmetic care program, but also to guide and encourage the user, by the display of messages on the screen of the smartphone (500).

According to a fourth aspect, the smartphone is connected with other connected objects via the WPAN. Said connected objects are, for instance, related to lifestyle and to well being, for example, a connected scale (510), a connected fitness apparatus, or a connected wristband measuring the physical activity. The expert system of the smartphone recommends an evolutionary cosmetic care program adapted to the lifestyle of the user and its follow-up of the program, and displays encouragement messages prompting him to persevere in the aforementioned program.

According to a fifth aspect, the smartphone (500) is connected via Internet (550) to a social network server (592) and connects the user to other users of the device, also connected via their smartphones (501), in order to share their experience and their results, thus creating a community of users, supporting each other in the observance of the proposed cosmetic care programs.

Advantageously, the application installed on the smartphone (500) allows the user to order on line the cosmetic products adapted to its program, so that they are timely delivered in accordance with its needs in the course of the aforesaid cosmetic care program.

The description hereinabove and the exemplary embodiments, show that the invention achieves the targeted aim, more specifically, the structural characteristics of the device of the invention supplemented by the sensors, allow the implementation of a self-massage under optimal conditions. In its connected version, the device of the invention enables the user to implement a personalized cosmetic care program and to support him in the progress of this program through the expert system and a community of users.

The invention claimed is:

1. A massager device to perform a palpate-roll type massage, comprising:

a structure comprising a contact face and a handling face, the contact face comprising a base of elliptic contour and a skirt, on its periphery, projecting on the periphery of the base, made of a flexible material configured to glide on a skin of a user and protecting the contact face from water;

a pair of notched rollers on the contact face of the structure to provide the palpate-roll type massage, inside the contour of the base, the notched rollers freely rotates around intersecting axes, the notched rollers being attached to the structure by elastic suspensions so that the notched rollers are projecting under the base and the skirt when free from pressure and lift up in the base when a pressure is applied;

a gripping shape on the handling face of the structure, opposite to the contact face, the gripping shape forming a cap of a semi-ellipsoidal shape, covering a whole contour of the base, with a length, measured along a major axis of an ellipse, ranging between 120 mm and 170 mm, a width, measured along a minor axis of the ellipse, ranging between 70 mm and 100 mm, and a height measured from the base to a top of the cap, ranging between 30 mm and 50 mm;

a dispensing orifice on the contact face, the dispensing orifice configured to dispense a cosmetic product of a cosmetic product tank, the dispensing orifice is aligned with a point of intersection of rotation axes of the notched rollers in front of the notched rollers in a direction of use of the massager device;

the cosmetic product tank being placed inside the cap and in a fluid communication with the dispensing orifice; and wherein a stiffness of the elastic suspensions of the notched rollers and their relative positions to the contact face and the skirt are configured so that a massaging pressure is set when the skirt comes into contact with the skin.

2. The massager device according to claim 1, wherein the dispensing orifice is closed by an obturator and the obturator opens in response to a pressure applied to the contact face.

3. The massager device according to claim 2, wherein an opening of the obturator is driven by a displacement of the elastic suspensions of the notched rollers.

4. The massage device of claim 2, wherein the base, the skirt surrounding the notched rollers and the dispensing orifice with the obturator prevents a washout of the cosmetic product in a massage area during a wet condition use of the massage device.

5. The massager device according to claim 1, further comprising a pump to expel the cosmetic product from the cosmetic product tank to the dispensing orifice; and a knob to actuate the pump.

6. The massager device according to claim 5, wherein the pump and the knob are constituted by a flexible membrane closing the cosmetic product tank on the handling face so that a pressure on the flexible membrane changes a volume of the cosmetic product tank.

7. The massager device according to claim 1, further comprising at least one of the following sensors: a transducer configured to indicate a pressure applied on the notched rollers, a transducer configured to indicate a moving speed of the massager device and a direction of rotation of the notched rollers, and a sensor to measure a temperature of a skin of a user.

8. The massager device according to claim 7, further comprising an electronic unit comprising: a memory, an input port, an output port, and a microprogram to acquire and analyze information in a form of signals issued by said at least one sensor.

9. The massager device according to claim 8, wherein the electronic unit comprises a radio transceiver to establish a connection with a connected object over a personal wireless network.

10. The massager device according the claim 9, wherein the connected object is a smartphone.

11. The massager device according to claim 1, wherein the cosmetic product tank is removable and interchangeable.

* * * * *